US010373463B1

(12) United States Patent
Herring

(10) Patent No.: US 10,373,463 B1
(45) Date of Patent: Aug. 6, 2019

(54) PHYSICAL WALLET SEPARATION ALERT SYSTEM AND METHOD OF OPERATING THEREOF

(71) Applicant: Romare Herring, Granada Hills, CA (US)

(72) Inventor: Romare Herring, Granada Hills, CA (US)

( * ) Notice: Subject to any disclaimer, the term of this patent is extended or adjusted under 35 U.S.C. 154(b) by 0 days.

(21) Appl. No.: 15/925,757

(22) Filed: Mar. 19, 2018

(51) Int. Cl.
*G08B 13/24* (2006.01)
*G08B 21/18* (2006.01)
*G08B 21/24* (2006.01)

(52) U.S. Cl.
CPC ..... *G08B 13/2462* (2013.01); *G08B 21/182* (2013.01); *G08B 21/24* (2013.01)

(58) Field of Classification Search
CPC ... G08B 13/2462; G08B 21/182; G08B 21/24
USPC ..... 340/539.32, 539.15, 539.13, 539.11
See application file for complete search history.

(56) References Cited

U.S. PATENT DOCUMENTS 8,707,460 B2 * 4/2014 Cabouli ..... A45C 1/06 713/172
8,866,607 B2 * 10/2014 Velusamy ..... G08B 13/1427 340/539.11
9,224,015 B2 * 12/2015 Cabouli ..... A45C 1/06
9,489,821 B2 * 11/2016 King ..... G08B 21/24
9,589,405 B2 * 3/2017 Cabouli ..... G06F 21/32
2006/0232398 A1 * 10/2006 Nedblake ..... G08B 13/1427 340/539.13
2009/0077675 A1 * 3/2009 Cabouli ..... A45C 1/06 726/34
2010/0164715 A1 * 7/2010 Buller ..... G08B 13/1427 340/539.32
2011/0148625 A1 * 6/2011 Velusamy ..... G08B 13/1427 340/539.13
2011/0285506 A1 * 11/2011 Hillis ..... G08B 21/0238 340/8.1
2015/0170496 A1 * 6/2015 King ..... G08B 21/24 340/686.6
2016/0035212 A1 * 2/2016 Gorzelic ..... G08B 21/24 340/539.32

(Continued)

*Primary Examiner* — Joseph H Feild
*Assistant Examiner* — Rufus C Point
(74) *Attorney, Agent, or Firm* — Invent Capture, LLC.; Samuel S. Cho

(57) ABSTRACT

A physical wallet separation alert system capable of detecting, alerting, and defining a potentially-dangerous separation between a physical wallet and a mobile communication device is disclosed. In one example, the potentially-dangerous separation involves a user-defined "excessive" separation (e.g. a few meters, ten meters, twenty meters, etc.) between the physical wallet and the mobile communication device that may suggest a potential loss or theft of the physical wallet or the mobile communication device during a real-time tracking of the separated distance by a wallet separation prevention application executed by the mobile communication device. A physical wallet separation alert may be visual, aural, textual, or a combination thereof. The physical wallet separation alert system is capable of simultaneously tracking multiple physical wallets that are registered with the system. Furthermore, each registered physical wallet integrates a wireless tag configured to be accessed by an RFID reader incorporated into the mobile communication device.

7 Claims, 5 Drawing Sheets

An Embodiment of a Physical Wallet Separation Alert System Detecting a Registered Physical Wallet within a User-Defined Distance

(56) References Cited

U.S. PATENT DOCUMENTS

2016/0098878 A1* 4/2016 Cabouli ..... G06F 21/32
340/5.52
2017/0006425 A1* 1/2017 Tang ..... H04W 4/021

* cited by examiner

An Embodiment of a Physical Wallet Separation Alert System Detecting a Registered Physical Wallet within a User-Defined Distance

100

An Embodiment of a Physical Wallet Separation Alert System Generating an Urgent Alert to a User after Detecting No Registered Physical Wallet(s) within a User-Defined Distance

200

An Embodiment of a Physical Wallet Separation Alert System Showing Pairing & Registration Process for Physical Wallet(s) that Embed Wireless Identification Tag(s)

300

An Embodiment of a Mobile Communication Device Executing a Wallet Separation Prevention App in a Physical Wallet Separation Alert System

400

An Operating Flowchart for a Physical Wallet Separation Alert System

500

PHYSICAL WALLET SEPARATION ALERT SYSTEM AND METHOD OF OPERATING THEREOF

BACKGROUND OF THE INVENTION

The present invention generally relates to an item range monitoring, separation alert generation, and recovery assistance. More specifically, the present invention relates to a novel physical wallet separation alert system that dynamically tracks a physical separation between a physical wallet and a mobile communication device. The present invention also relates to a method of operating the novel physical wallet separation alert system.

Despite a continuing evolution of virtual wallets and virtual electronic wallet-based mobile payment systems, a vast majority of consumers still today prefer to carry a physical wallet or a purse for everyday transactions. Some consumers find fiddling with virtual wallets in checkout counters unnecessarily cumbersome, while others are weary of potential electronic transaction information piracy in public storefronts and other unknown security risks associated with virtual wallets. Furthermore, many consumers simply prefer to carry physical wallets, handbags, and/or purses because these traditional transactional canyon apparatuses allow consumers to store identification cards, business cards, paper receipts, and credit cards tangibly and physically in one place without necessitating annoying virtualization and electronic storage of such sensitive information in a mobile device, which may be subject to unexpected battery drains, system crashes, ransomware attacks, and/or other unforeseen electronic problems that may interfere with seamless daily commerce expected by many consumers.

The persisting consumer preferences of carrying physical wallets even in the era of rapidly-evolving mobile device transaction services have caused many people to carry physical wallets and smart phones at the same time. In numerous instances, consumers have suffered accidental loss or theft of physical wallets in stores, shopping malls, buses, and other public locations, especially because many consumers today are more attentive to accessing their smart phones in public than keeping track of their physical wallets. The modern trend of carrying multiple electronic devices (e.g. multiple smart phones, tablet computers, wearable devices, etc.) in public further distracts consumers and increases chances of accidental loss or theft of physical wallets.

Therefore, it may be desirable to devise a novel electronic system capable of detecting and alerting a potentially-dangerous separation beyond an allowed range between a physical wallet and a mobile communication device.

Furthermore, it may also be desirable to devise a novel electronic system that enables a user to define and modify a threshold distance value beyond an allowed range for triggering an alert for a physical wallet separation.

Moreover, it may also be desirable to devise a method of operating a novel electronic system configured to detect, alert, and define a potentially-dangerous separation between a physical wallet and a mobile communication device.

SUMMARY

Summary and Abstract summarize some aspects of the present invention. Simplifications or omissions may have been made to avoid obscuring the purpose of the Summary or the Abstract. These simplifications or omissions are not intended to limit the scope of the present invention.

In one embodiment of the invention, a physical wallet separation alert system is disclosed. This physical wallet separation alert system comprises: a physical wallet incorporating an RFID tag that stores an identification dataset that uniquely identifies the physical wallet when the RFID tag is accessed; a wallet separation prevention app module configured to generate an electronic user interface that allows a user to define a threshold distance value for an alarm-worthy separation between the physical wallet and a mobile communication device, wherein the wallet separation prevention app module also tracks a real-time separation distance between the physical wallet and the mobile communication device and alerts the user when the threshold distance value is exceeded; an RFID reader integrated into the mobile communication device, wherein the RFID reader is configured to read the identification dataset from the RFID tag incorporated into the physical wallet and to track the real-time separation distance between the physical wallet and the mobile communication device by continuously or periodically interrogating the RFID tag; and the mobile communication device incorporating a CPU and a memory unit, which are configured to execute one or more mobile applications originating from the wallet separation prevention module.

In another embodiment of the invention, a method for operating a physical wallet separation alert system is disclosed. This method comprises the steps of: activating the physical wallet separation alert system by turning on a mobile communication device and invoking execution of a wallet separation prevention application in the mobile communication device; determining whether a user wants to register or pair a physical wallet with the mobile communication device by taking a user input from an electronic user interface generated by the wallet separation prevention application; and if the physical wallet needs to be registered, interrogating an RFID tag embedded in the physical wallet with an RFID reader integrated into the mobile communication device to fetch a wallet-identifying identification dataset from the physical wallet, and pairing the wallet-identifying identification dataset with the wallet separation prevention application if permitted by the user via the electronic user interface; else if the physical wallet does not need to be registered currently, attempting to detect an already-registered physical wallet within a user-defined wallet detection range from the mobile communication device, and generating a wallet separation alert if the already-registered physical wallet is not detected within the user-defined wallet detection range.

DETAILED DESCRIPTION

Figure 1:
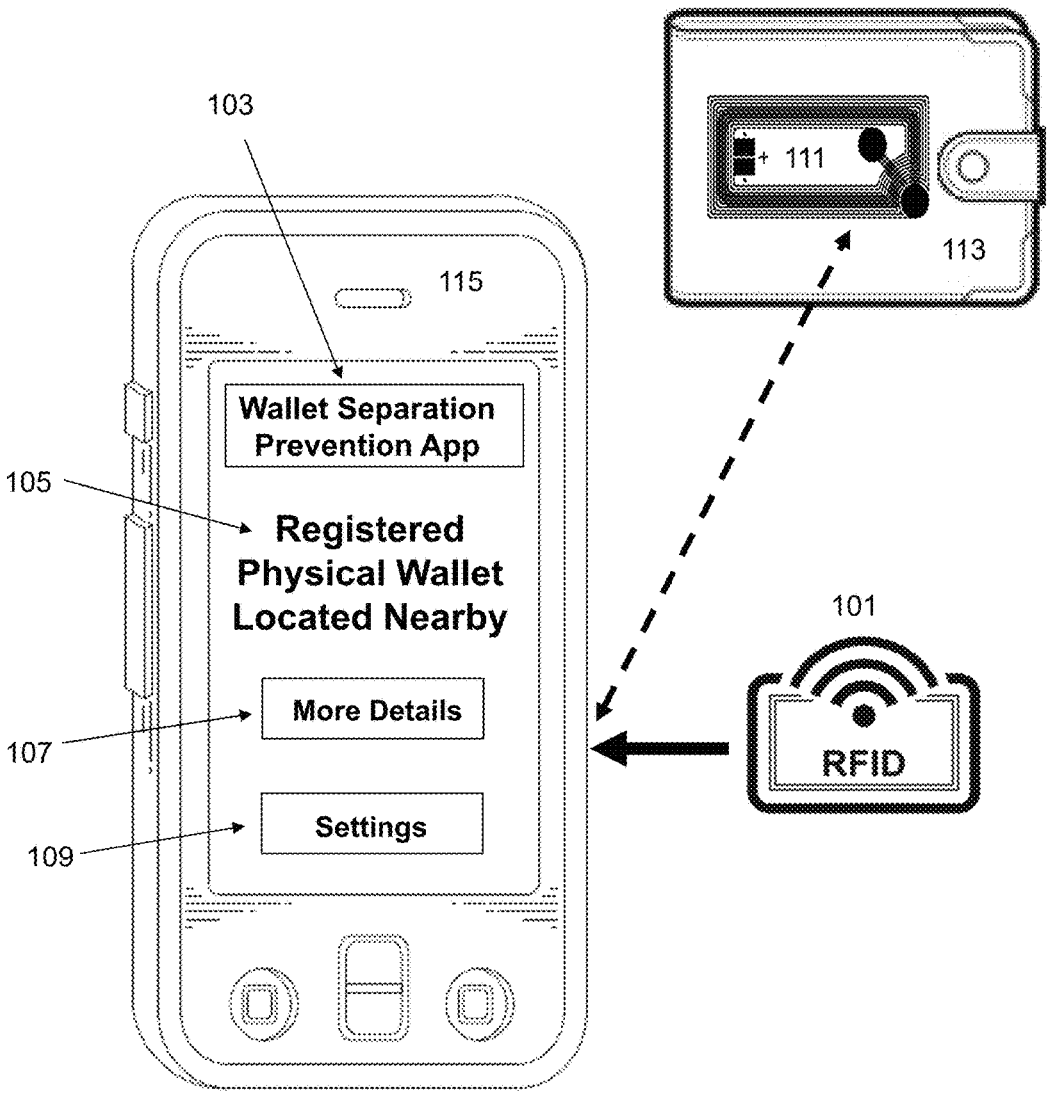
FIG. 1 shows an embodiment of a physical wallet separation alert system detecting a registered physical wallet within a user-defined distance, in accordance with an embodiment of the invention.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

The detailed description is presented largely in terms of description of shapes, configurations, and/or other symbolic representations that directly or indirectly resemble one or more physical wallet separation alert systems and methods of operating such systems. These process descriptions and representations are the means used by those experienced or skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment. Furthermore, separate or alternative embodiments are not necessarily mutually exclusive of other embodiments. Moreover, the order of blocks in process flowcharts or diagrams representing one or more embodiments of the invention does not inherently indicate any particular order and do not imply any limitations in the invention.

One aspect of an embodiment of the present invention is to provide a novel physical wallet separation alert system capable of detecting and alerting a potentially-dangerous separation beyond an allowed range between a physical wallet and a mobile communication device.

Another aspect of an embodiment of the present invention is to provide a novel physical wallet separation alert system that enables a user to define and modify a threshold distance value beyond an allowed range for triggering an alert for a physical wallet separation.

Furthermore, an additional aspect of an embodiment of the present invention is to provide a method of operating a novel physical wallet separation alert system, which is configured to detect, alert, and define a potentially-dangerous separation between a physical wallet and a mobile communication device.

For the purpose of describing the invention, a term referred herein as "physical wallet" is defined as a portable holder for paper bills, identification cards, credit cards, and/or coins. For example, a physical wallet, in context of various embodiments of the present invention, may be a billfold wallet, a wallet integrating a coin pocket, a purse, or a handbag for males or females. In one embodiment of the invention, a physical wallet may incorporate, integrate, or include an RFID tag, a wireless transceiver, or another wireless receiver as a factory-spec part or an aftermarket part to enable range tracking and wallet identification by a mobile communication device. In another embodiment of the invention, a physical wallet may be a "smart wallet" that integrates not only an RFID tag or another wireless receiver, but also at least one of a vibrator, a speaker, a display panel, or another electronic alert-capable component to initiate a physical wallet separation alert from the physical wallet itself, even if the mobile communication device is not currently accessible by the user.

Furthermore, for the purpose of describing the invention, a term referred herein as "threshold distance value" is defined as an alert-triggering distance for an increased separation between a physical wallet and a mobile communication device. A threshold distance value may have an initial default value (e.g. 5 meters, 10 meters, etc.) specified by a mobile app developer, a device manufacturer, or a service provider. In some instances, the threshold distance value for a physical wallet separation alert may be modified by a user via a user interface menu on a wallet separation prevention app to conform to specific user preferences.

In addition, for the purpose of describing the invention, a term referred herein as "radio frequency identification," or "RFID," is defined as a wireless tag or a wireless object identification technology. An RFID reader is configured to detect, read from, and/or write to an RFID tag via LF or UHF-range radio frequencies. In one example, the RFID tag may contain a passive (i.e. battery-less) electronic circuity that can be energized in the presence of electromagnetic fields generated by the RFID reader for enabling a data readout or a data write-in to a non-volatile memory storage in the RFID tag. In another example, the RFID tag may contain a battery-powered active circuitry that can communicate bilaterally with the RFID tag reader, even if the RFID tag reader does not initiate communication. In context of various embodiments of this invention, Bluetooth and Near-Field Communications (NFC) protocols, related tags, and transceivers are also referred herein interchangeably as "RFID," "RFID readers," and/or "RFID tags," along with LF or UHF RFID readers and tags.

In addition, for the purpose of describing the invention, a term referred herein as "mobile communication device" is defined as a portable electronic device which, at a minimum, can display useful information received from another device. Typically, a mobile communication device also provides wireless communication, data storage, and computation capabilities. Examples of mobile communication devices include, but are not limited to, a cellular phone, a portable computer, a tablet device with one or more touch screens, and a portable gaming device.

FIG. 1 shows a preferred embodiment of a physical wallet separation alert system (100) detecting a registered physical wallet (113) within a user-defined distance, in accordance with an embodiment of the invention. In the preferred embodiment as shown in this figure, the physical wallet separation alert system (100) comprises the registered physical wallet (113), an RFID tag (111) integrated into the registered physical wallet (113), a mobile communication device (115), an RFID reader module (101) integrated into the mobile communication device (115), and a wallet separation prevention mobile app (103) executed in an APU/CPU and a memory unit of the mobile communication device (115).

The RFID reader module (101) is designed to detect presence of the RFID tag (111) up to a protocol-specific defined range. For example, an LF RFID reader module or an NFC reader module may be able to detect protocol-compatible tags up to 30 centimeters, while a UHF RFID reader module or a Bluetooth transceiver module may be able to detect protocol-compatible tags up to 1~15 meters. The RFID reader module (101) may be an integrated circuit and/or an embedded software encased in the mobile communication device (115) as a factory-spec feature. Alternatively, the RFID reader module (101) may be a detachable dongle that can be plugged into or removed from an external surface of the mobile communication device (115).

Furthermore, the registered physical wallet (113) incorporates the RFID tag (111), which may be battery-powered as active circuitry in some embodiments, or passively energized via electromagnetic induction from the RFID reader module (101). In the preferred embodiment of the invention, the RFID tag (111), at a minimum, contains electronic information that identifies the registered physical wallet (113), when the wallet separation prevention mobile app (103) executed in the mobile communication device (115) invokes identity verification with the registered physical wallet (113). If a wallet is already registered by the wallet separation prevention mobile app (103), a distance between the wallet (e.g. the registered physical wallet (113)) and the mobile communication device (115) is measured, polled, and/or extrapolated periodically or continuously.

If the current measurement of the wallet separation reaches or exceeds a threshold distance value (e.g. 10 meters), then the wallet separation prevention mobile app (103) is configured to generate a visual, textual, and/or aural alert to indicate that the mobile communication device user's wallet (e.g. 113) is getting farther apart from the mobile communication device (115) to exceed the threshold distance value. If the mobile communication device user's wallet (e.g. 113) comes closer to the mobile communication device (115) again under the threshold distance value, then the visual, textual, and/or aural alert, if already generated in previous timeframes, may be dynamically canceled, revoked, or removed in real time from various user interfaces. The physical wallet separation alert may be a visual alert on a mobile device display screen, an email alert, a text message alert, an aural alarm, or a combination thereof. Furthermore, in one embodiment of the invention, the physical wallet may incorporate, integrate, or include an RFID tag, a wireless transceiver, or another wireless receiver as a factory-spec part or an aftermarket part to enable range tracking and wallet identification by a mobile communication device. In another embodiment of the invention, the physical wallet may be a "smart wallet" that integrates not only an RFID tag or another wireless receiver, but also at least one of a vibrator, a speaker, a display panel, or another electronic alert-capable component to initiate a physical wallet separation alert from the physical wallet itself, even if the mobile communication device is not currently accessible by the user.

On the other hand, if the current measurement of the distance between the mobile communication device (115) and the registered physical wallet (113) is below the threshold distance value, then wallet separation prevention mobile app (103) may instead indicate that the registered physical wallet (113) is located "nearby," or under the threshold distance value, as shown on a wallet position status bar (105) in FIG. 1. Furthermore, the wallet separation prevention mobile app (103) is also configured to generate additional user menu choices, such as a "more details" button (107) and a "settings" button (109). In this embodiment of the invention, the "more details" button (107) allows the user to review, monitor, or modify details associated with the registered physical wallet (113) or another registered or registrable wallet item in the menu interface generated by the wallet separation prevention mobile app (103), as shown in FIG. 1. Moreover, the "settings" button (109) enables the user to register, modify, or cancel authenticated pairing of one or more physical wallets and the mobile communication device (115). In some embodiments of the invention, the "settings" button (109), when pressed to lead the user into a settings menu interface on a touchscreen display of the mobile communication device (115), may also empower the user to set or modify the threshold distance value (e.g. 5 meters, 10 meters, etc.) for defining a particular separation alert triggering range between registered physical wallet(s) and the mobile communication device (115).

Figure 2:
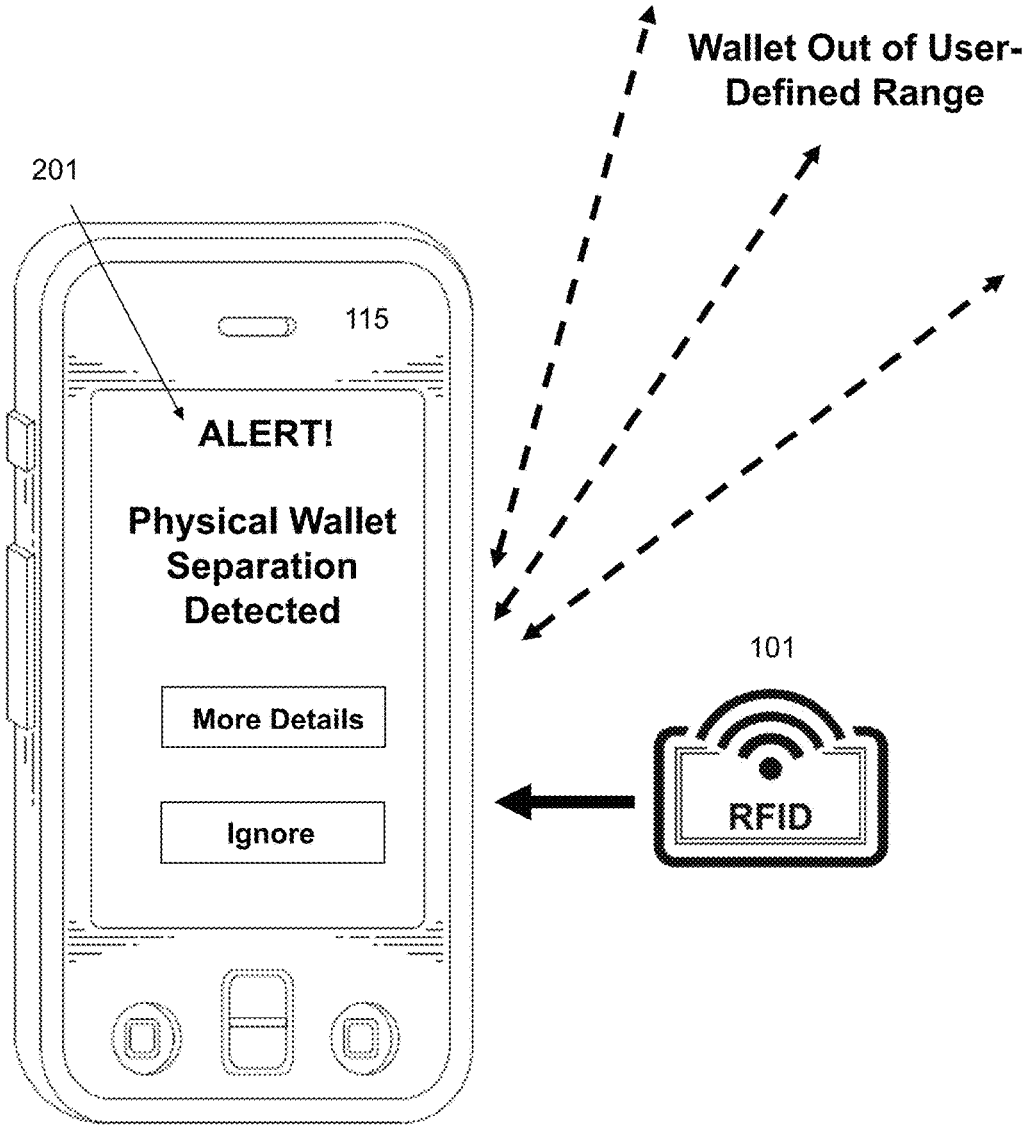
FIG. 2 shows an embodiment of a physical wallet separation alert system generating an urgent alert to a user after detecting no registered physical wallet(s) within a user-defined distance, in accordance with an embodiment of the invention.

FIG. 2 shows an embodiment of a physical wallet separation alert system (200) generating an urgent alert to a user after detecting no registered physical wallet(s) within a user-defined distance, in accordance with an embodiment of the invention. In this embodiment, the physical wallet separation alert system (200) comprises registered one or more physical wallets that are either beyond RFID readout range or breaching a user-defined separation alert trigger distance, an RFID tag (e.g. 111 of FIG. 1) integrated into each registered physical wallet (e.g. 113 of FIG. 1), a mobile communication device (115), an RFID reader module (101) integrated into the mobile communication device (115), and a wallet separation prevention mobile app (e.g. 103 of FIG. 1) executed in an APU/CPU and a memory unit of the mobile communication device (115).

In this embodiment of the invention, the RFID reader module (101) is designed to detect presence of one or more RFID tags simultaneously up to a protocol-specific defined range. As shown in FIG. 2, when no physical wallets are found within the protocol-specific (e.g. NFC, UHF RFID, LF RFID, Bluetooth, etc.) tag readable range, the physical wallet separation alert system recognizes that the registered physical wallets are separated beyond the threshold distance value, which may be equal to or less than the protocol-specific tag readable range. In another embodiment of the invention, a user-defined threshold distance value is set at half of the protocol-specific tag readable range. For example, a user can set a 2.5-meter user-defined threshold distance value for a UHF RFID-based tag reader module that has a physical tag readout range of 5 meters. In this example, although an RFID tag integrated into a physical wallet is still readable when it is located at 3 meters from the UHF RFID reader, the current location of the physical wallet clearly exceeds the user-defined threshold distance value of 2.5 meters between the physical wallet and the mobile communication device (115). Therefore, in this instance, the wallet separation prevention mobile app (e.g. 103 of FIG. 1) executed in the APU/CPU and the memory unit of the mobile communication device (115) generates a physical wallet separation alert (201) to notify the user of potential loss or theft of the physical wallet.

Furthermore, as shown in FIG. 2, if the current measurement of the wallet separation reaches or exceeds a threshold distance value (e.g. 5 meters), then the wallet separation prevention mobile app is able to generate a visual, textual, and/or aural alert (e.g. 201) to indicate that the mobile communication device user's wallet (e.g. 113 in FIG. 1) is getting farther apart from the mobile communication device (115) to exceed the threshold distance value. If the mobile communication device user's wallet (e.g. 113 of FIG. 1) comes closer to the mobile communication device (115) to stay under the threshold distance value, then the visual, textual, and/or aural alert, if already generated in previous timeframes, may be dynamically canceled, revoked, or removed in real time from various user interfaces. The physical wallet separation alert may be a visual alert on a mobile device display screen, an email alert, a text message alert, an aural alarm, or a combination thereof.

On the other hand, if the current measurement of the distance between the mobile communication device (115) and a registered physical wallet (e.g. 113 in FIG. 1) is below the threshold distance value, then wallet separation prevention mobile app may instead indicate that the registered physical wallet is located "nearby," or under the threshold distance value, as shown on previously in FIG. 1. Furthermore, the wallet separation prevention mobile app is also configured to generate additional user menu choices, such as a "more details" button and an "ignore" button. As shown in a touchscreen electronic user interface generated by the wallet separation prevention mobile app for the mobile communication device (115) in FIG. 2, the user may request more details about the physical wallet separation alert (201), or may simply instruct the physical wallet separation alert system to ignore the alert.

Figure 3:
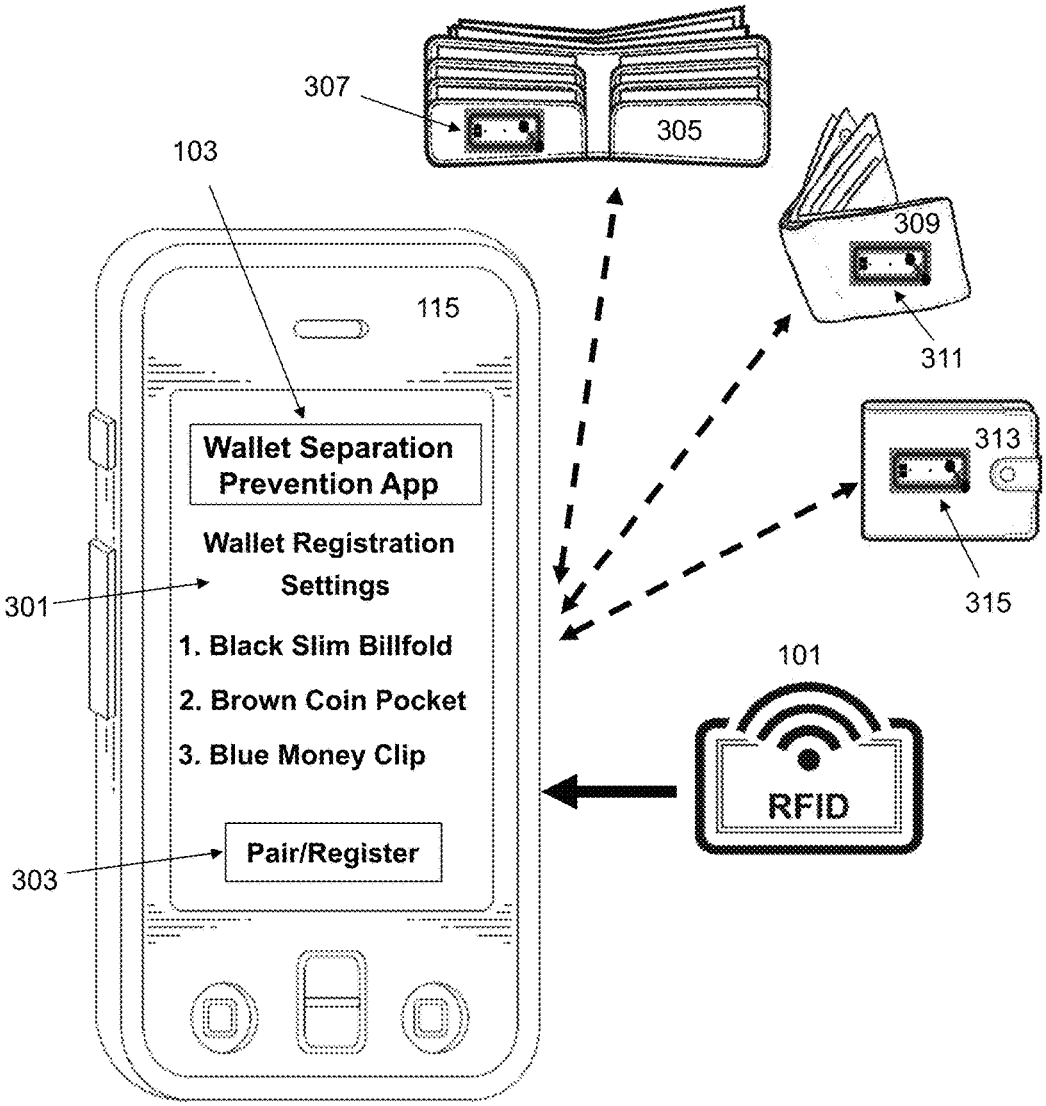
FIG. 3 shows an embodiment of a physical wallet separation alert system showing a pairing and registration process for physical wallet(s) that embed wireless identification tag(s), in accordance with an embodiment of the invention.

FIG. 3 shows an embodiment of a physical wallet separation alert system (300) showing a pairing and registration process for a plurality of physical wallets (305, 309, 313) that embed wireless identification tags (307, 311, 315) in each physical wallet, in accordance with an embodiment of the invention. The wallet separation prevention mobile app (103) executed in the APU/CPU and a memory unit of the mobile communication device (115) is capable of registering each physical wallet in a physical wallet information database associated with the wallet separation prevention mobile app (103) by pairing a wireless tag ID stored in each wireless identification tag (e.g. 307, 311, 315) with a user-entered or user-selected description for each physical wallet (e.g. "black slim billfold," "brown coin pocket," or "blue money clip"), as shown in FIG. 3.

Furthermore, the wallet separation prevention mobile app (103) is configured to generate a wallet registration settings user interface (301) that enables the user to register, pair, unpair, or modify information associated with a plurality of registrable physical wallets (e.g. 305, 309, 313). Once a particular physical wallet is registered and paired with the mobile communication device (115) via the wallet separation prevention mobile app (103) that may contain a "pair/register" activation button (303) in the wallet registration settings user interface (301), the separating distance between the particular physical wallet and the mobile communication device (115) can be tracked in real time.

If the separating distance exceeds a user-defined threshold distance value, then a physical wallet separation alert is triggered to inform the user of potential loss or theft of the particular physical wallet. Alternatively, if the physical wallet is a "smart wallet" that integrates not only a wireless identification tag, but also at least one of a vibrator, a speaker, a display panel, or another electronic alert-capable component for initiating a physical wallet separation alert from the physical wallet itself, then the alert may be triggered via the vibrator, the speaker, the display panel, or another electronic alert-capable component integrated in the smart wallet to inform the user that the mobile communication device (115) is now separated beyond the user-defined threshold distance value.

Figure 4:
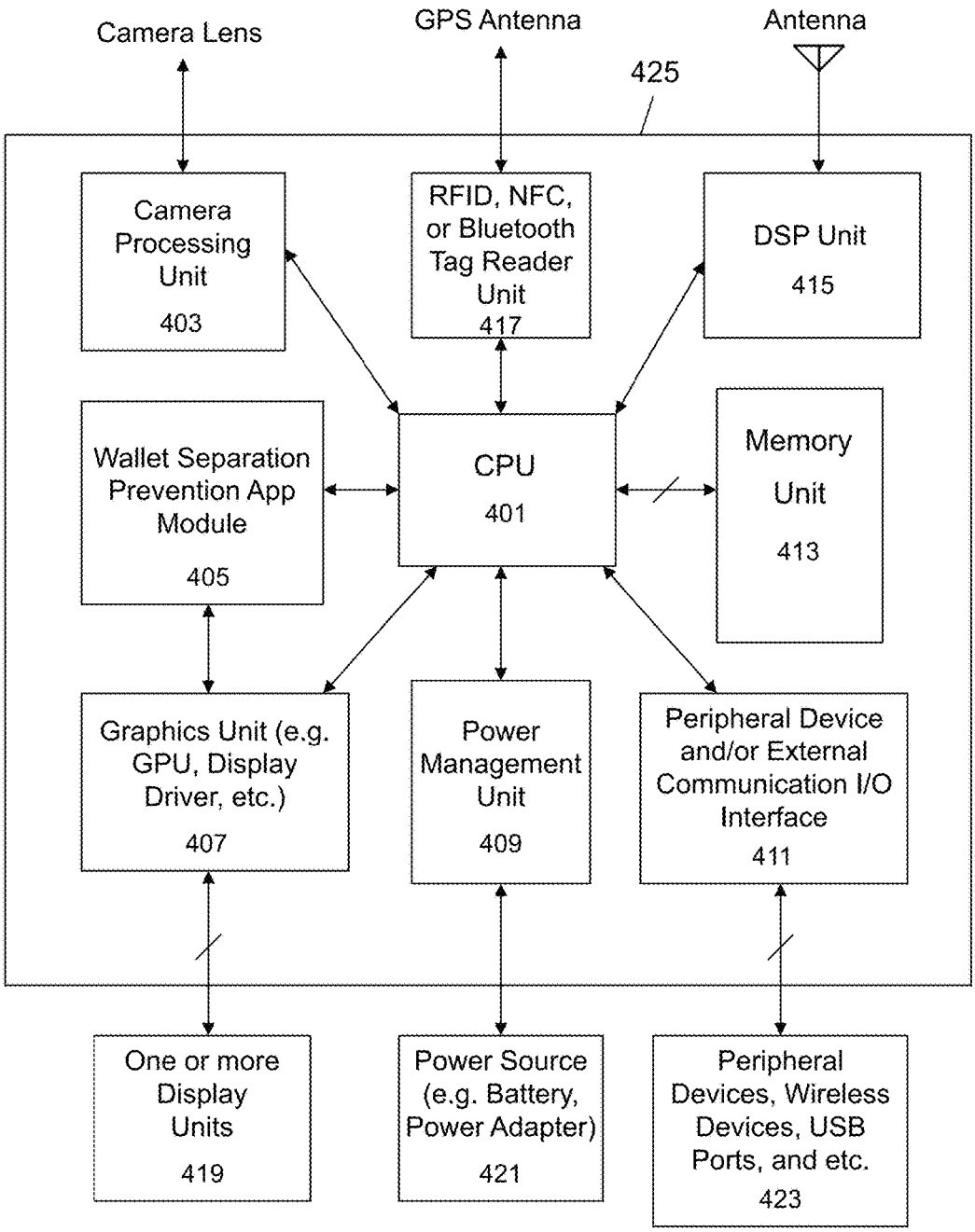
FIG. 4 shows an embodiment of a mobile communication device executing a wallet separation prevention application in a physical wallet separation alert system, in accordance with an embodiment of the invention.

FIG. 4 shows an embodiment of a logical block diagram (400) of a mobile communication device executing a wallet separation prevention application module (405) in a physical wallet separation alert system, in accordance with an embodiment of the invention. In a preferred embodiment of the invention, the mobile communication device has a CPU (401) which is operatively connected to a memory unit (413), the wallet separation prevention application module (405), a RFID, NFC, or Bluetooth tag reader unit (417), a camera processing unit (403), a graphics unit (407) (e.g. a graphics processor, a display driver, and etc.), a power management unit (409), a peripheral device and/or external communication I/O interface (411), a digital signal processing (DSP) unit (415), and optionally a sound unit suitable for generating an audio alert in case of an excessive wallet separation. These logical units may be placed on a single printed circuit board (425) in one embodiment of the invention, or a plurality of printed circuit boards in another embodiment of the invention.

In the preferred embodiment of the invention, the CPU (401) is configured to control each logical unit operatively (i.e. directly or indirectly) connected to the CPU (401). The memory unit (413) typically comprises volatile memory banks based on DRAM's. In some embodiments of the invention, the memory unit (413) may use non-volatile memory technologies such as SRAM's and/or Flash memory. The memory unit (413) is capable of storing programs and applications which can be executed by the CPU (401), the graphics unit (407), or another logical unit operatively connected to the memory unit (413). In particular, in the preferred embodiment of the invention, a wallet separation prevention app stored or chip-encoded in the wallet separation prevention application module (405) is executed on the CPU (401) and the memory unit (413) of the mobile communication device. This wallet separation prevention app may be part of an operating system of the mobile communication device, or a separate mobile application installed on the operating system of the mobile communication device.

In one embodiment of the invention, the RFID, NFC, or Bluetooth tag reader unit (417) is a hardware module configured to interrogate, read data from, and write data to a wireless tag or a wireless transceiver that is located within a protocol-defined access range (e.g. 30 centimeters or up to a few meters). The RFID, NFC, or Bluetooth tag reader unit (417) is controlled in part by a software or a chip-encoded program originating from the wallet separation prevention app module (405), and is able to detect and communicate with an RFID, NFC, or Bluetooth tag incorporated into a physical wallet. The wallet separation prevention app module (405) and the RFID, NFC, or Bluetooth tag reader unit (417) are configured to register and track one or more nearby physical wallets for real-time changes in separating distances between the mobile communication device and the nearby physical wallets. If a registered physical wallet exceeds a user-defined threshold distance value, then the wallet separation prevention app module (405) further communicates with the CPU (401), the graphics unit (407), the DSP unit (415), and/or the sound unit to generate a wallet separation alert in form of a graphical alert on a display panel, an email alert, a text alert, an audio alert, and/or another multimedia alert.

Furthermore, as shown in FIG. 4, the digital signal processing (DSP) unit (415) is operatively connected to an radio frequency (RF) antenna. The DSP unit (415) is generally configured to receive and transmit radio data and/or voice signals wirelessly for the mobile communication device. Moreover, the power management unit (409) is operatively connected to a power supply unit and a power source (e.g. battery, power adapter) (421), and the power management unit (409) generally controls power supplied to a mobile communication device and its logical units. In addition, the peripheral device and/or external communication I/O interface (411) as shown in FIG. 4 can be operatively connected to one or more peripheral devices, wireless devices, USB ports, and other external data communication media (423).

Continuing with FIG. 4, in the preferred embodiment of the invention, the graphics unit (407) for the mobile communication device executing the wallet separation prevention app comprises a graphics processor, a display driver, a dedicated graphics memory unit, and/or another graphics-related logical components. In general, the graphics unit (407) is able to process and communicate graphics-related data with the CPU (401), the display driver, and/or the dedicated graphics memory unit. The graphics unit (407) is also operatively connected to one or more display units (419). In addition, the CPU (401) may be operatively connected to the sound unit, which contains audio-related logical components for generation or recording of audio data from the mobile communication device.

Figure 5:
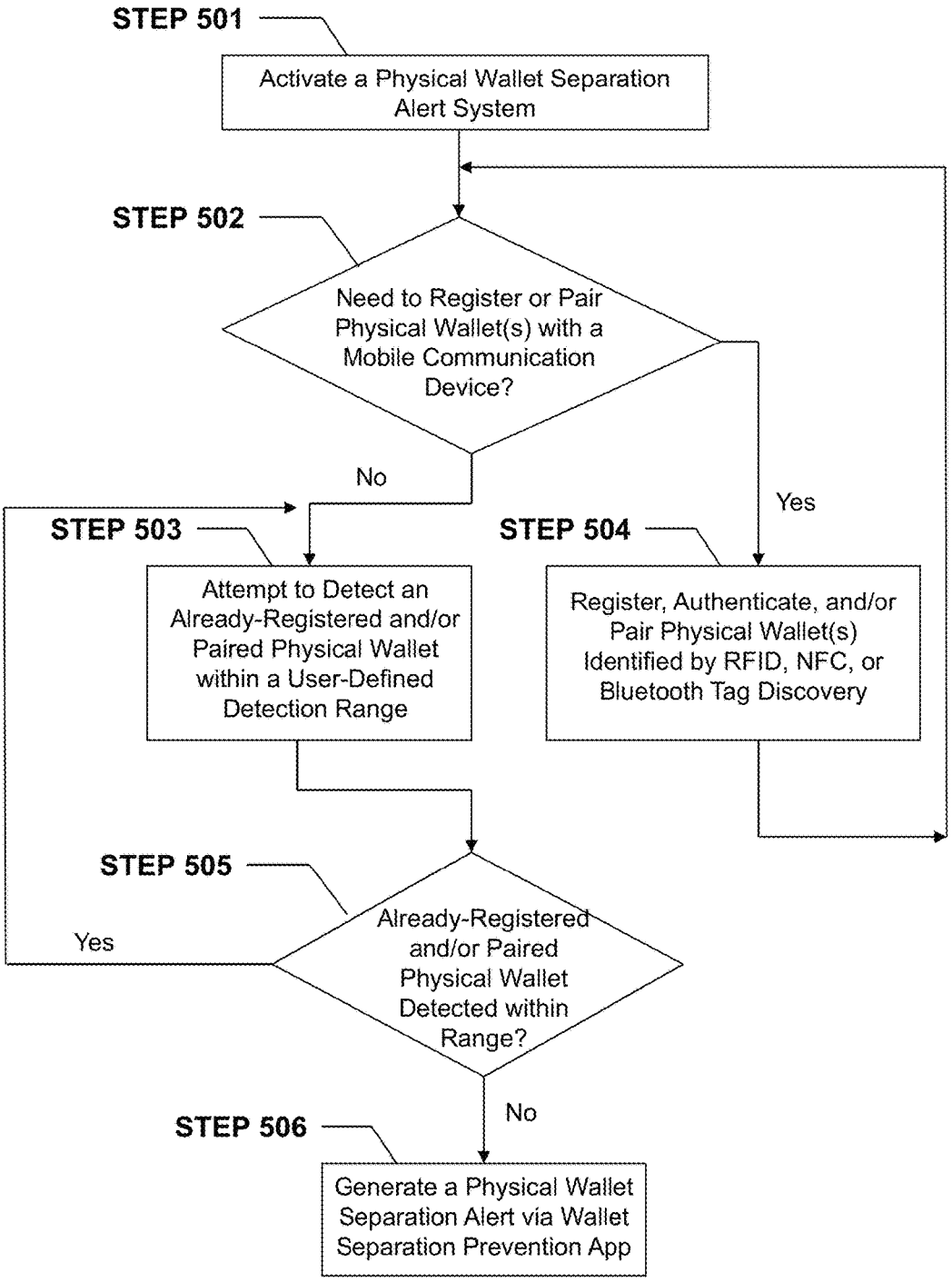
FIG. 5 shows an embodiment of an operating flowchart for a physical wallet separation system, in accordance with an embodiment of the invention.

FIG. 5 shows an embodiment of an operating flowchart (500) for a physical wallet separation system, in accordance with an embodiment of the invention. As shown in the operating flowchart (500), the first step for operating this system involves a user activating the physical wallet separation alert system, which may involve turning on a mobile communication device and invoking execution of a wallet separation prevention app by touching a mobile app icon, voice commands, or other methods of executing a mobile device application, as shown in STEP 501. Then, if the user wants to register or pair a previously-unregistered physical wallet with the mobile communication device, as shown in STEP 502, the wallet separation prevention app provides a corresponding user interface menu for registration, authentication, and/or pairing of the selected physical wallet identified by either automated or manual RFID, NFC, or Bluetooth tag discovery methods, as shown in STEP 504. The user can also iterate similar procedures multiple times to register, authenticate, and/or pair a plurality of physical wallets with the wallet separation prevention app, as shown in the operating flowchart (500).

If the user does not need to register or pair new or additional physical wallets, then the physical wallet separation alert system attempts to detect an already-registered and/or paired physical wallet within a user-defined detection range, as shown in STEP 503. If the already-registered and/or paired physical wallet is detected within the user-defined range, as shown in STEP 505, then the physical wallet separation alert system keeps tracking the current separation between the mobile communication device and the already-registered and/or paired physical wallet, as shown by the loopback arrow from STEP 505. Optionally, the real-time separation distance may be displayed via an electronic user interface operated by the wallet separation prevention application. On the other hand, if the already-registered and/or paired physical wallet is no longer found or not detected within the user-defined range, then the physical wallet separation alert system generates a physical wallet separation alert via the wallet separation prevention app, as shown in STEP 506.

The present invention in various embodiments, as described in association with FIGS. 1-5, provides several advantages to mobile communication device users who still prefer to carry physical wallets for their travel and in-store shopping endeavors. In particular, one or more embodiments of the present invention can prevent or reduce accidental loss or theft of a physical wallet by implementing a novel physical wallet separation alert system, which is capable of detecting and alerting a potentially-dangerous separation beyond an allowed range between the physical wallet and a mobile communication device.

Furthermore, another advantage of an embodiment of the present invention is empowering a user to define and modify a threshold distance value that triggers an alert for physical wallet separation via a mobile user interface, when the threshold distance value is exceeded between a physical wallet and a mobile communication device. Moreover, an additional advantage of an embodiment of the present invention is providing a user-friendly method of operating a novel physical wallet separation alert system, which is configured to detect, alert, and define a potentially-dangerous separation between a physical wallet and a mobile communication device.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A physical wallet separation alert system comprising:

a smart physical wallet incorporating a vibrator, a speaker, and a display panel within a surface of the smart physical wallet to initiate a physical wallet separation alert from the smart physical wallet itself to indicate that a mobile communication device is nowhere to be found nearby, even when a user has no user interface access to the mobile communication device, wherein the smart physical wallet also incorporates an RFID tag that stores an identification dataset that uniquely identifies the smart physical wallet when the RFID tag is accessed;

a wallet separation prevention app module executed in the smart physical wallet to generate an electronic user interface on the smart physical wallet that allows the user to define a threshold distance value for an alarm-worthy separation between the smart physical wallet and the mobile communication device, wherein the wallet separation prevention app module also tracks a real-time separation distance between the smart physical wallet and the mobile communication device and alerts the user when the threshold distance value is exceeded;

an RFID reader integrated into the mobile communication device, wherein the RFID reader is configured to read the identification dataset from the RFID tag incorporated into the smart physical wallet and to track the real-time separation distance between the smart physical wallet and the mobile communication device by continuously or periodically interrogating the RFID tag; and the mobile communication device incorporating a CPU and a memory unit, which are configured to execute one or more mobile applications originating from the wallet separation prevention module.

2. The physical wallet separation alert system of claim 1, further comprising a graphics unit operatively connected to the CPU, and a display unit operatively connected to the graphics unit, wherein the display unit provides a touch-screen user interface to display a wallet position status bar, a wallet separation alert, or a wallet registration settings menu.

3. The physical wallet separation alert system of claim 1, further comprising a camera processing unit, a digital signal processing unit, and a power management unit inside the mobile communication device, wherein the power management unit is operatively connected to a power source.

4. The physical wallet separation alert system of claim 1, wherein the threshold distance value is configured from a factory default setting or dynamically adjusted by the user via the electronic user interface originating from the wallet separation prevention app module.

5. The physical wallet separation alert system of claim 1, wherein the RFID reader is configured to communicate with the RFID tag via a long-frequency (LF) RFID protocol, an ultra-high frequency (UHF) RFID protocol, a near-field communication (NFC) protocol, or a Bluetooth-compliant protocol.

6. The physical wallet separation alert system of claim 1, wherein the wallet separation prevention app module is configured to recognize and track separating distances between the mobile communication device and a plurality of physical wallets simultaneously.

7. The physical wallet separation alert system of claim 1, wherein the mobile communication device is a smart phone, a tablet computer, a notebook computer, or another portable electronic device carried by the user during travel, business, or shopping activities.

* * * * *